US008857738B2

(12) United States Patent
Knopow et al.

(10) Patent No.: US 8,857,738 B2
(45) Date of Patent: Oct. 14, 2014

(54) REFILLABLE DEVICES FOR DISPENSING FLUIDS

(75) Inventors: Jeremy F. Knopow, Burlington, WI (US); Jeffrey L. Crull, McFarland, WI (US); Lawrence J. Fenske, West Lafayette, IN (US); Cunjiang Cheng, Madison, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1214 days.

(21) Appl. No.: 12/450,383

(22) PCT Filed: Mar. 26, 2008

(86) PCT No.: PCT/US2008/003926

§ 371 (c)(1),
(2), (4) Date: Dec. 15, 2009

(87) PCT Pub. No.: WO2008/118446

PCT Pub. Date: Oct. 2, 2008

(65) Prior Publication Data

US 2010/0090027 A1 Apr. 15, 2010

Related U.S. Application Data

(60) Provisional application No. 60/908,312, filed on Mar. 27, 2007, provisional application No. 60/946,848, filed on Jun. 28, 2007, provisional application No. 60/990,186, filed on Nov. 26, 2007.

(51) Int. Cl.

| | |
|---|---|
| ***A62C 31/00*** | (2006.01) |
| ***A62C 5/02*** | (2006.01) |
| ***B05B 7/26*** | (2006.01) |
| ***B05B 7/30*** | (2006.01) |
| ***B67D 7/28*** | (2010.01) |
| ***B67D 7/06*** | (2010.01) |
| ***B05B 11/00*** | (2006.01) |
| ***B65D 83/68*** | (2006.01) |
| ***B65D 83/14*** | (2006.01) |
| *B05B 7/24* | (2006.01) |

(52) U.S. Cl.

CPC ..... *B05B 11/0037* (2013.01); *B05B 11/0054* (2013.01); *B05B 7/2416* (2013.01); *B05B 7/2421* (2013.01); *B05B 7/2443* (2013.01); *B05B 7/2472* (2013.01); *B05B 11/0056* (2013.01); *B05B 11/3011* (2013.01); *B65D 83/68* (2013.01); *B65D 83/75* (2013.01)

USPC ..... 239/305; 239/310; 239/318; 222/144; 222/144.5; 222/145.5; 222/383.1

(58) Field of Classification Search

CPC .. B05B 7/2443; B05B 7/2472; B05B 11/0054

USPC ..... 239/310, 312, 316, 322, 333, 303–308, 239/318, 525, 526; 222/144–145.6, 222/382–383.1, 130, 132, 136, 145.1

See application file for complete search history.

(56) References Cited

U.S. PATENT DOCUMENTS 1,090,863 A * 3/1914 Kelley ..... 137/255
3,003,703 A * 10/1961 Lambton ..... 239/309

(Continued)

FOREIGN PATENT DOCUMENTS

EP 1726532 11/2006

(Continued)

*Primary Examiner* — Len Tran
*Assistant Examiner* — Alexander M Valvis

(57) ABSTRACT

A device (10) for selectively dispensing ones of multiple fluids, preferably cleaning agents, is disclosed. The device includes a reservoir (50) and a container assembly (100) that can include at least one container body (105, 110, 112, 114, 116). The reservoir (50) houses a diluent "D," for example, water, and each container body houses a concentrate "C," for example, a concentrated form of a cleaning agent. Each container body has an outlet assembly (200) with a nozzle (260), so that container assemblies (100) with multiple container bodies correspondingly include multiple nozzles (260). The diluent "D" and concentrates "C" are kept separate from each other, whereby ho end use product is stored in the device (10). Rather, end use product is mixed on demand during dispensation, as part of the, dispensing act. Namely, diluent "D" is pumped through an outlet assembly (200), drawing concentrate "C" thereinto which mixes into the end use product while exiting the device (10).

10 Claims, 7 Drawing Sheets

(56) References Cited

U.S. PATENT DOCUMENTS

| | | | | |
|---|---|---|---|---|
| 3,454,042 | A * | 7/1969 | Phillips | 137/565.11 |
| 4,135,646 | A * | 1/1979 | Shaw | 222/144 |
| 5,152,431 | A | 10/1992 | Gardner et al. | |
| 5,433,350 | A * | 7/1995 | Graubart | 222/136 |
| 5,439,141 | A | 8/1995 | Clark et al. | |
| 5,472,119 | A * | 12/1995 | Park et al. | 222/145.8 |
| 5,529,216 | A | 6/1996 | Klima et al. | |
| 5,626,259 | A * | 5/1997 | Maas et al. | 222/136 |
| 5,651,398 | A * | 7/1997 | Decker et al. | 141/18 |
| 5,788,125 | A | 8/1998 | Steiner et al. | |
| 5,836,479 | A | 11/1998 | Klima et al. | |
| 5,871,122 | A | 2/1999 | Klima et al. | |
| 5,890,624 | A | 4/1999 | Klima et al. | |
| 5,906,318 | A | 5/1999 | Gurko, III et al. | |
| 5,947,332 | A | 9/1999 | Klima, Jr. et al. | |
| 5,994,223 | A | 11/1999 | Kim | |
| 6,073,808 | A | 6/2000 | Klima et al. | |
| 6,123,230 | A | 9/2000 | Klima, Jr. et al. | |
| 6,152,326 | A | 11/2000 | Klima, Jr. et al. | |
| 6,182,865 | B1 | 2/2001 | Bunschoten et al. | |
| 6,279,836 | B1 * | 8/2001 | Toetschinger et al. | 239/70 |
| 6,319,453 | B1 | 11/2001 | Klima, Jr. et al. | |
| 6,375,041 | B1 | 4/2002 | Klima et al. | |
| 6,431,402 | B1 | 8/2002 | Klima et al. | |
| 6,431,468 | B1 | 8/2002 | Brown et al. | |
| 6,540,109 | B1 | 4/2003 | Klima et al. | |
| 6,568,562 | B1 | 5/2003 | Klima, Jr. et al. | |
| 6,659,311 | B2 | 12/2003 | Prueter | |
| 6,789,708 | B2 * | 9/2004 | Hansen | 222/505 |
| 6,843,390 | B1 * | 1/2005 | Bristor | 222/145.5 |
| 6,869,028 | B2 * | 3/2005 | Bartsch et al. | 239/315 |
| 7,104,467 | B2 | 9/2006 | Crossdale et al. | |
| 7,147,172 | B2 | 12/2006 | Darling, III et al. | |
| 7,168,629 | B2 | 1/2007 | Timmes et al. | |
| 7,188,786 | B2 * | 3/2007 | Dodd | 239/310 |
| 7,222,802 | B2 | 5/2007 | Sweeton | |
| 7,243,676 | B2 | 7/2007 | Bailey | |
| 7,302,971 | B2 | 12/2007 | Myntti | |
| 7,331,486 | B2 | 2/2008 | Mon et al. | |
| 7,331,488 | B2 | 2/2008 | Naslund et al. | |
| 7,370,813 | B2 | 5/2008 | Hubmann et al. | |
| 7,448,556 | B2 | 11/2008 | Muehlhausen | |
| 7,478,738 | B2 * | 1/2009 | Jones et al. | 222/383.1 |
| 7,519,985 | B2 | 4/2009 | Kawamura et al. | |
| 7,565,988 | B2 | 7/2009 | Foster | |
| 7,568,596 | | 8/2009 | Laidler et al. | |
| 7,654,415 | B2 | 2/2010 | Van der Heijden | |
| 7,789,278 | B2 | 9/2010 | Ruiz de Gopegui et al. | |
| 7,793,678 | B2 | 9/2010 | Edwards et al. | |
| 2002/0100769 | A1 * | 8/2002 | McKune | 222/129 |
| 2002/0117558 | A1 | 8/2002 | Timmes et al. | |
| 2002/0170981 | A1 | 11/2002 | Decker et al. | |
| 2002/0190134 | A1 * | 12/2002 | Johnson | 239/10 |
| 2003/0038186 | A1 | 2/2003 | Klima et al. | |
| 2004/0222315 | A1 | 11/2004 | Habatjou | |
| 2006/0021919 | A1 | 2/2006 | Olson et al. | |
| 2007/0189834 | A1 | 8/2007 | McKay, Sr. | |
| 2008/0001002 | A1 | 1/2008 | Garon | |
| 2008/0011779 | A1 | 1/2008 | Klima et al. | |
| 2008/0029551 | A1 | 2/2008 | Lombardi | |
| 2008/0047921 | A1 | 2/2008 | Klabbers et al. | |
| 2008/0049414 | A1 | 2/2008 | McKay, Sr. | |
| 2008/0049415 | A1 | 2/2008 | McKay, Sr. | |
| 2008/0061089 | A1 | 3/2008 | Wellman | |
| 2008/0062674 | A1 | 3/2008 | McKay, Sr. | |
| 2008/0144426 | A1 | 6/2008 | Janssen et al. | |
| 2008/0223875 | A1 | 9/2008 | LaFlamme et al. | |
| 2009/0095768 | A1 | 4/2009 | Phillips et al. | |
| 2009/0107559 | A1 | 4/2009 | Edwards et al. | |
| 2009/0194610 | A1 | 8/2009 | Bober et al. | |
| 2010/0132814 | A1 | 6/2010 | Schiller et al. | |
| 2010/0181345 | A1 | 7/2010 | Hilarides | |

FOREIGN PATENT DOCUMENTS

| | | |
|---|---|---|
| WO | WO9530491 | 11/1995 |
| WO | WO2006043935 | 4/2006 |
| WO | WO2006058433 | 6/2006 |
| WO | WO2006105574 | 10/2006 |
| WO | WO2007001488 | 1/2007 |
| WO | WO2008010169 | 1/2008 |
| WO | WO2008014833 | 2/2008 |
| WO | WO2008076941 | 6/2008 |
| WO | WO2008104029 | 9/2008 |
| WO | WO2008112737 | 9/2008 |
| WO | WO2008118446 | 10/2008 |
| WO | WO2009007657 | 1/2009 |
| WO | WO2009049316 | 4/2009 |
| WO | WO2009058230 | 5/2009 |

* cited by examiner

REFILLABLE DEVICES FOR DISPENSING FLUIDS

CROSS-REFERENCE TO RELATED APPLICATIONS

This international application claims the benefit of and priority to U.S. provisional application 60/908,312, filed Mar. 27, 2007; U.S. provisional application 60/946,848, filed Jun. 28, 2007; and U.S. provisional application 60/990,186, filed Nov. 26, 2007; each of which is herein expressly incorporated by reference in its entirety, for all purposes.

BACKGROUND OF THE INVENTION

1. Field of the Invention

The present invention relates to chemical dispensation devices and, more specifically, to a device for selectively dispensing ones of a variety of liquid-based chemical compositions.

2. Discussion of the Related Art

In typical households, residences, and other domestic dwellings, as well as within commercial and business buildings, many chemical cleaning agents are used in performing numerous common home cleaning, freshening, or other maintenance tasks. In a given area within a household, for example, within a single room, more than one cleaning agent can be used during a single cleaning session.

Accordingly, users of chemical cleaning agents occasionally must tote or carry around multiple containers of different chemical cleaning agents. In the alternative to transporting multiple chemical cleaning agents, the user is required to make multiple trips between the pieces being cleaned and, for example, the area where the cleaning agents are stored to exchange previously used agents for those which will be used subsequently.

While some cleaning tasks are performed at or near the location where chemical cleaning agents are stored, the user is still required to handle numerous individual products. As one example, many individuals keep or store various cleaning supplies within bathrooms, and bathroom cleaning typically requires the use of numerous chemical cleaning agents. Although such cleaning supplies might be stored within the bathroom, the user is still required to handle, use, manipulate, and switch between the various individual products.

Therefore, it is desirable to develop a dispensing device that can selectively dispense more than one cleaning agent, enabling a user to employ a single device for dispensing and using a variety of cleaning agents. Previous attempts to solve this problem include devices that allow for multiple, end-use products to be dispensed through a single valve. For example, U.S. Pat. Nos. 3,298,611 and 4,595,127 disclose variations of an aerosol can delivery system that selectively allows one of multiple fluids to be dispensed through a single spray nozzle. Disadvantages of this technology are that multiple, end-use products are dispensed through a single nozzle and there is potential for cross-contamination as the user switches between products. Also, including multiple products in a single container will either increase the size and weight of the dispensing container with each end-use product included or the volume of each product will be reduced, resulting in more frequent refills or replacements of the dispensing container.

Therefore, it is also desirable to provide a dispensing device which includes multiple, replaceable, concentrated cleaning chemistries for use with a single diluent dispenser. Other attempts have focused on providing a single replaceable, concentrated chemistry for use with a single solvent. For example, it is known to allow for a bottle to be refilled multiple times by providing cartridges containing a concentrated agent. The concentrated agent is delivered by one of several means into the bottle wherein it is combined with a solvent, preferably water, to create the usable product. While these references allow for multiple combinations of cartridges and solutions, concentrated or not to be used in refilling the bottle, the primary disadvantage with this system is that the concentrate and the solution are entirely combined prior to use within the bottle. This allows the bottle to be used to dispense only a single solution at any particular time. Further, the entire contents of the bottle must be dispensed or disposed of prior to using a different chemistry within the bottle.

There are no known prior art dispensers that allow multiple, replaceable, concentrated cleaning chemistries to be selectively used with a single diluent dispenser. What is therefore needed is a chemical or end product dispensing device which dispenses multiple cleaning agents from separate output nozzles to mitigate the likelihood of cross-contaminating the various chemistries and reduce the dependency on multiple dispensing devices for dispensing multiple end use products.

SUMMARY AND OBJECTS OF THE INVENTION

Consistent with the foregoing, and in accordance with the invention as embodied and broadly described herein, a dispensing device and container assemblies for use with the dispensing device are disclosed in suitable detail to enable one of ordinary skill in the art to make and use the invention.

According to a first embodiment of the present invention, a device is presented for dispensing multiple end use products, preferably multiple cleaning solutions. The device includes a reservoir and a container assembly that can include at least one container body. The reservoir houses a diluent, for example, water, and each container body houses a concentrate, for example, a concentrated form of a cleaning agent. Each container body has an outlet assembly with a nozzle, so that container assemblies with multiple container bodies correspondingly include multiple nozzles. The diluent and concentrates are kept separate from each other, whereby no end use product is stored in the device. Rather, end use product is mixed on demand during dispensation, as part of the dispensing act. Namely, diluent is pumped through an outlet assembly drawing concentrate thereinto which mixes into the end use product while exiting the device.

In another embodiment, the dispensing device includes a manually actuated pump that is configured to pump the diluent out of the reservoir, whereby discrete actuation of the pump produces discrete mixing and dispensing acts.

In yet another embodiment, the diluent is water. Furthermore, the concentrate can be a concentrated form of a glass cleaner, a bathroom cleaner, a furniture polish, an all purpose household cleaner, or other chemistries, as desired.

In some embodiments, the body portion, handle, head portion, and container assembly define a generally continuous structure with a void space defined transversely therethrough. This facilitates, e.g., filling the reservoir with tap water by inserting a faucet through the void space defined transversely through the device and aligning the facet with a reservoir inlet.

In yet other embodiments, the dispensing device is sized and configured to hold a volume of liquid that will not be burdensome to carry or manipulate. In other words, the dispensing device is sized so that the overall weight of the dispensing device, when full of diluent and concentrate(s), is acceptable to the user, even during extended periods of use. For example, (i) the container assembly can hold less than about twelve ounces of fluid, less than about ten ounces of fluid, or other volumes as desired, and (ii) the reservoir can hold less than about thirty-two ounces of liquid, less than about twenty-four ounces of liquid, less than about twelve ounces of liquid, less than about eight ounces of liquid, or other volumes of liquid, as desired, depending on the intended end use of the dispensing device.

In another embodiment, the container assembly is rotatable about a generally vertical axis of rotation for selecting a desired end use product for dispensation. Optionally, the container body can rotate about a generally horizontal axis of rotation for selecting a desired end use product for dispensation. Furthermore, a rotatable frame can removably hold one or more container bodies of the container assembly.

These and other aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
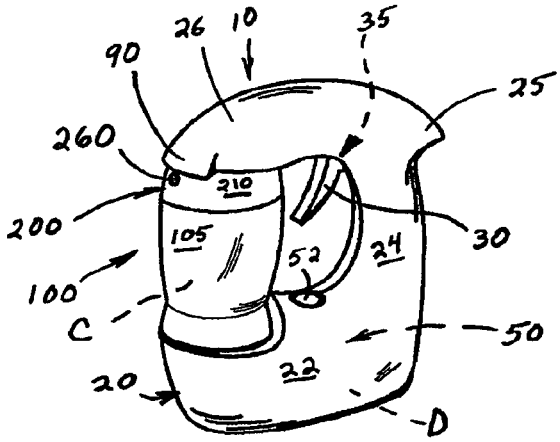
FIG. 1 is a perspective view of a first embodiment of a dispensing device of the present invention.

In describing the preferred embodiments of the invention which are illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the words connected, attached, or terms similar thereto are often used. However, they are not limited to direct connection but include connection through other elements where such connection is recognized as being equivalent by those skilled in the art.

DETAILED DESCRIPTION OF THE INVENTION

The present invention and the various features and advantageous details thereof are explained more fully with reference to the non-limiting embodiments described in detail in the following description.

I. System Overview

In a basic form, referring generally to FIGS. 1-9, the invention is a fluid dispensing device, preferably, a hand-held device, e.g., dispensing device 10, that holds a diluent "D" and at least one concentrated substance or concentrate "C" separate from each other. The diluent "D" and concentrate "C," remain separate until they are actively dispensed and mix with each other momentarily while exiting the device, whereby an end use product exits the dispensing device 10.

The diluent "D" can be a liquid diluent and/or other suitable fluid carrier, preferably, a solvent and, more preferably, water. The concentrate "C" can be a concentrated liquid chemical composition, or a gaseous, powdered, or other relatively concentrated substance. The dispensed end use products, made from actively mixing the diluent "D" and concentrate "C" during dispensation, can be any of a variety of compositions, agents, and/or solutions, preferably, one or more of numerous cleaning solutions or chemicals.

Exemplary of such end use products include, but are not limited to: general purpose cleaners, kitchen cleaners, bathroom cleaners, dust inhibitors or removal aids, floor and furniture cleaners and polishes, glass cleaners, anti-bacterial cleaners, fragrances, deodorizers, soft surface treatments, fabric protectors, tire cleaners, dashboard cleaners, automotive interior cleaners, and/or other automotive industry cleaners or polishes, or even insecticides. In some embodiments, a single device 10 dispenses multiple end use products that use a common fluid carrier or diluent "D." Accordingly, the particular components, compositions, constituents, and respective concentrations of the diluent "D" and one or more concentrates "C" are selected based on the particular desired end use product that will be actively mixed while exiting the dispensing device 10.

In such configuration, the dispensing device 10 is designed to allow a user to quickly replace or replenish the diluent "D" or ones of the one or more concentrate "C" as needed or desired. In some implementations, e.g., the user can select from multiple end use products to dispense from a single hand-held dispensing device 10 those which incorporate multiple, different concentrates "C". This provides convenient access to different products and, for example, easier cleaning of multiple surfaces that require a different cleaning product be used on each of them.

II. Detailed Description of Preferred Embodiments

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the examples discussed herein should not be construed as limiting the scope of the present invention.

1. Dispensation Generally

Referring still to FIGS. 1-9, the dispensing device 10 is manually activated, preferably by a manual pump-type, electrical pump-type, aerosol, pressurized, and/or other delivery system to dispense an end use product, preferably, a cleaning solution. During the act of dispensation, a diluent "D" and a concentrate "C" are combined and mixed with each other, e.g., at least partially prior to exiting the device so that they emerge as a final, combined, ready-to-use solution or end use product, preferably, a cleaning solution or cleaning chemical composition.

In this regard, the acts of dispensing and mixing or combining the diluent "D" and concentrate "C" are not mutually exclusive. Rather, discrete mixing acts of the diluent "D" and concentrate "C" are performed in concert with discrete dispensation acts. Correspondingly, a volume of end use product need not be stored in the device, since the dispensation effectuates suitable mixing of the diluent "D" and concentrate "C" in creating the resultant end use product.

It is noted that the particular dispensation techniques and methods are selected based, at least in part, on the intended end use of dispensing device 10. In other words, dispensing device 10 is adapted for dispensation by way of, e.g., manual pump-type, electrical pump-type, aerosol, pressurized, or other delivery systems in view of considerations such as viscosity, flow, density, and/or other characteristics of the diluent "D," concentrate "C," or end use product(s), as well as the end use environment or other operational considerations.

Regardless of the particular dispensing technique or method used, the dispensing device 10 can be configured to operate by pumping or otherwise expelling the diluent "D" so that the diluent "D," as it flows through the dispensing device 10, draws the concentrate "C" into its flow path by way of, e.g., pressure differentials according to Bernoulli's principles, explained in greater detail elsewhere herein. In this configuration, only the diluent "D" needs to be acted upon in order to suitably mix and dispense both the diluent "D" and concentrate "C" as an end use product.

1a. Manual Pump Dispensation

Referring now to FIGS. 1-7, some embodiments the dispensing device 10 function based primarily on principles associated with manually actuated, trigger-type spray bottles. In such embodiments, the dispensing device 10 includes a trigger 30 that actuates a piston within or otherwise operates a manual pump assembly 35. Any of a variety of known types, styles, or configurations of manual pumps and/or their respective components, e.g., pitons, dip tubes, check valves, valve seats, compression or return springs, and others are suitable for use as manual pump assembly 35, all of which are well known to those skilled in the art.

1b. Non-Manual Pump Dispensation

Figure 8:
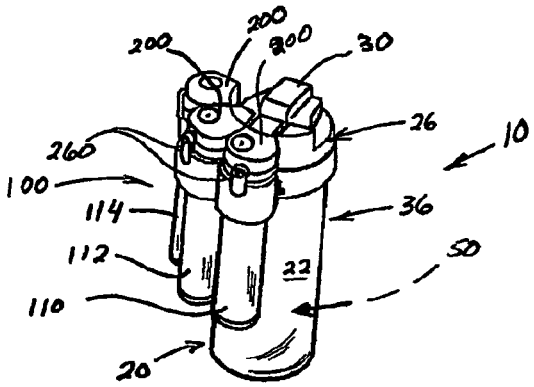
FIG. 8 is a perspective view of a seventh embodiment of a dispensing device of the present invention.
Figure 9:
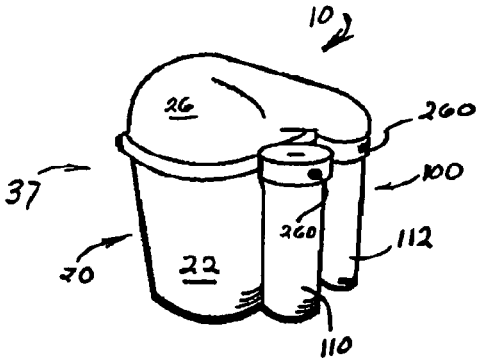
FIG. 9 is a perspective view of an eighth embodiment of a dispensing device of the present invention.

Referring now to FIGS. 8-9, some embodiments of dispensing device 10 do not use manually actuated or trigger-style pumps, but rather use other forces to expel contents from the dispensing device 10. For example, the dispensing device 10 seen in FIG. 8 utilizes aerosol dispensation by way of an aerosol system 36. Any of a variety of known types, styles, or configurations of aerosol systems and/or their respective components, e.g., a propellant such as pressurized gas or liquefied gas or others, dip tubes, check valves, valve seats, compression or return springs, and others are suitable for use as aerosol system 36, all of which are well known to those skilled in the art. As another example, the dispensing device 10 seen in FIG. 9, utilizes pressurized dispensation by way of a pressurized system 37. Here again, any of a variety of known types, styles, or configurations of stored positive pressure-based systems and/or their respective components, e.g., a pressure vessel, dip tubes, check valves, valve seats, compression or return springs, electronic (i) pumps, (ii) switches or triggers, (iii) power supplies (iv) corresponding conductors and other circuit components, and/or others are suitable for use as pressurized system 37, all of which are well known to those skilled in the art.

2. General Device Architecture

Referring now to FIGS. 1-9, dispensing device 10 and its components and subassemblies are preferably made from generally lightweight and durable materials. Exemplary of suitable materials are lightweight polymeric materials or various polymeric compounds, such as, for example, and without limitation, various of the polyolefins, such as a variety of the polyethylenes, e.g., high density polyethylene, or polypropylenes. There can also be mentioned as examples such polymers as polyvinyl chloride and chlorinated polyvinyl chloride copolymers, various of the polyamides, polycarbonates, and others.

For any polymeric material employed in structures of the invention, any conventional additive package can be included such as, for example, and without limitation, slip agents, anti-block agents, release agents, anti-oxidants, fillers, and plasticizers to control, e.g., processing of the polymeric material as well as to stabilize and/or otherwise control the properties of the finished processed product, also to control hardness, bending resistance, and the like. Common industry methods of forming such polymeric compounds will suffice to form the polymeric components of dispensing device 10. Exemplary, but not limiting, of such processes are the various commonly-known plastic converting, molding, and/or other processes.

Dispensing device 10 preferably has a housing 20 that holds a reservoir 50 and a container assembly 100 that has an outlet assembly 200. The reservoir 50, container assembly 100, and outlet assembly 200 cooperate with each other for mixing and dispensing the diluent "D" and concentrate "C," which are stored in the reservoir 50 and container assembly 100, respectively, as an end use product. It is noted that by maintaining the diluent "D" and concentrate "C" as distinct stored entities, the user can refill or replace the diluent "D" independently from the concentrate "C" and vice versa.

Referring specifically to the manually actuated, trigger-type spray embodiments of FIGS. 1-7, each housing 20 includes a main body segment 22 at a lower portion thereof, and a handle 24 that extends generally upwardly from the main body segment 22. Handle 24 is configured to provide a suitably comfortable gripping structure enabling a user to hold and manipulate the dispensing device 10 for durations of time commensurate with the time required to dispense the end use product and/or carry the dispensing device 10 to different surfaces or rooms to be cleaned or treated. In some implementations, such as those seen in FIGS. 1, 3*a*, 3*b*, 4, and 6, the handle 24 can include a projection 25 which rests upon, e.g., an intersection of a thumb and forefinger of a user, enhancing the user's comfort and holding stability, especially during prolonged periods of use.

Referring still to FIGS. 1-7, head 26 extends outwardly from an upper portion of handle 24, in the same general direction as the main body segment 22. In this configuration, head 26 can extend at least partially over the main body segment 22 of housing 20. Preferably, various ones of, optionally all of, main body segment 22, handle 24, and head 26 are hollow, whereby the housing 20 defines a shell-like outer perimeter wall(s), encapsulating a void "V" (FIG. 11) therein which is configured to house various other components of the dispensing device 10 therein.

As desired, in some embodiments, the various components of the housing 20 are removably attached to each other, by way of friction fit, snap-lock, or otherwise. For example, (i) an assemblage of handle 24 and head 26 can be selectively removed from main body segment 22, (ii) head 26 can be selectively removed from an assemblage of main body segment 22 and handle 24, or (iii) each of the main body segment 22, handle 24, and head 26 can be selectively removed from respective ones of each other. The particular removable attachment(s) of the various components within the housing 20 to each other is directed at least on part by, e.g., how diluent is "D" is stored, housed, filled, or refilled, within a particular implementation of dispensing device 10.

Figure 10:
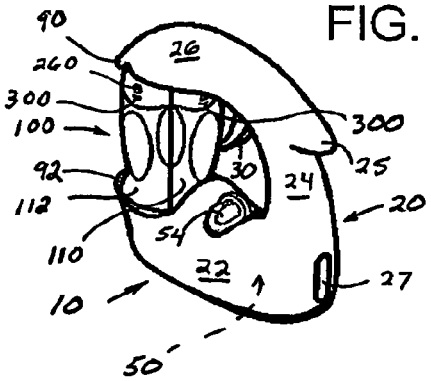
FIG. 10 is a perspective view of another variant of the dispensing device of FIG. 1.
Figure 11:
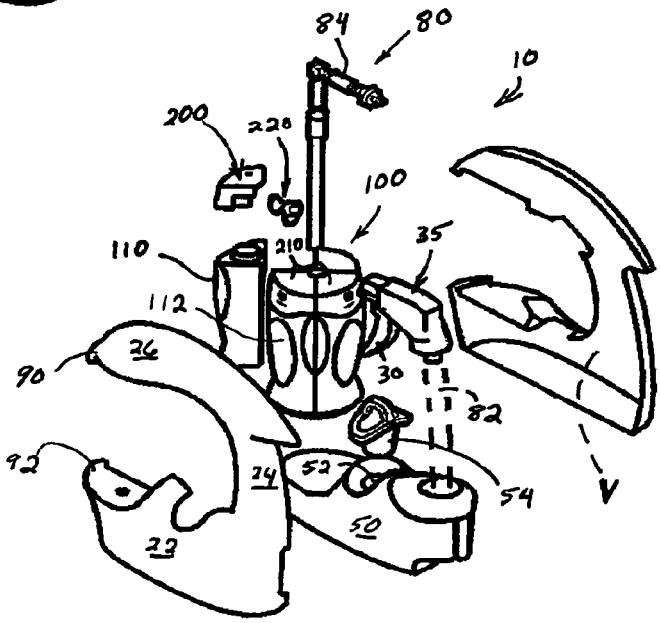
FIG. 11 is an exploded, perspective view of the device of FIG. 10.

Turning now to the embodiments of FIGS. 10-11 a sight window 27 can be provided upon the housing 20 and configured for enabling a user to easily, at a glance, evaluate the volume of carrier fluid within the reservoir 50 at any particular time.

As best seen in FIG. 11, reservoir 50 is housed within the void "V" of housing 20, is configured to hold a volume of diluent "D" therein, and is, preferably, made from a lightweight rigid polymeric material. In this configuration, the reservoir 50 functions as a stand-alone liquid tight enclosure, whereby any of a variety of suitable bottles, cans, and/or other enclosures may be implemented as reservoir 50.

The particular material(s) and configuration of reservoir 50 are selected based on the particular end use environment, the particular fluid or diluent "D" to be dispensed, and the type of delivery system used. For example, in lieu of a rigid polymeric reservoir 50 such as that seen in FIG. 11, as desired, reservoir 50 can instead be a flexible polymeric bag-type enclosure structure (not illustrated). The flexible polymeric bag embodiment of reservoir 50 can be adapted and configured for single use with subsequent disposal. Such implementations can be particularly desirable for implementations of dispensing device 10 that use diluents "D" which the user does not want to potentially touch, e.g., if the diluent "D" is or includes any of a variety of acidic, basic, caustic, or irritating substances. Notwithstanding, as desired, the flexible polymeric bag embodiment of reservoir 50 can be refillable and adapted and configured for multiple uses.

Referring again to FIGS. 10-11, reservoir 50 can include an inlet 52 and a removable plug 54. The inlet 52 extends through the outer wall of housing 20 opening and into the reservoir 50. For example, inlet 52 can extend through an upper wall of main body segment 22, entering reservoir 50, but can be located elsewhere such as, e.g., upon handle 24 or head 26 (FIG. 4), as long as the inlet 52 is fluidly connected to the reservoir 50.

Still referring to FIGS. 10-11, when the inlet 52 enters reservoir 50 through the upper wall of main body segment 22, the dispensing device 10 is preferably configured for filling or refilling with a volume of tap-water diluent "D" by way of, e.g., conventional bathroom sink basins and corresponding faucet fixtures. In other words, the height dimensions of the reservoir 50 and the corresponding portions of main body segment 22 of housing 20 are sufficiently small in magnitude or short enough to allow the user to slide the inlet 52 between a conventional sink basin and faucet, aligning the inlet 52 of reservoir 50 with an outlet of the faucet. Furthermore, there is preferably adequate clearance between the trigger 30 inlet 52, as well as other portions adjacent the inlet 52, so that the user need not actuate the trigger 30 while aligning inlet 52 with the faucet, or otherwise struggle during such diluent "D" refill alignment step.

As best seen in FIG. 11, a tubing assembly 80 is housed within the housing 20 and is configured for directing diluent "D" between reservoir 50 and container assembly 100. Tubing assembly 80 includes a pump inlet tubing 82 and a pump outlet tubing 84. Pump inlet tubing 82 spans between and connects the manual pump assembly 35 to the reservoir 50, and pump outlet tubing 84 spans between and connects the pump assembly 35 to the container assembly 100. In other words, the pump assembly 35 (*i*) draws diluent "D" from reservoir 50 through the pump inlet tubing 82 and pushes it to container assembly 100 through pump outlet tubing 84. In some embodiments, such as that illustrated in FIG. 11, part of the pump outlet tubing 84 is an elongate member 85 that extends downwardly, axially at least partially into the container assembly 100. In such embodiments, an outlet bore 86 extends radially, horizontally, or otherwise through the sidewall of the pump outlet tubing 84, adjacent its bottom end that interfaces the container assembly 100. The outlet bore 86 (FIG. 14) can be fluidly and operably connected to a portion of container assembly 100, for directing the diluent "D" therethrough while using dispensing device 10.

Referring again to FIGS. 10-11, in some embodiments, upper and lower retaining flanges 90, 92 are provided on housing 20 for, e.g., holding and aligning container assembly 100 during use. Upper and lower retaining flanges 90, 92 extend angularly forward from the front edges of the respective ends of the housing 20 that hold the container assembly 100. As desired, the upper and lower retaining flanges 90, 92 can have generally the same radius as the outer perimeter of housing 20, whereby they appear to be tabular extensions of the housing 20 outer wall. Optionally, the upper and lower flanges 90, 92 have other shapes and/or radii.

Regardless, the inwardly facing surfaces of flanges 90, 92, preferably, directly interface the outwardly facing surfaces of the container assembly 100. In this configuration, the retaining flanges 90, 92 mechanically urge the container assembly 100 rearward toward the remainder of the housing 20. This can help mitigate the likelihood of non-desired rotation, misalignment, or other movement of the container assembly 100 within the housing 20.

3. Concentrate Container Assembly Generally

Referring now to FIGS. 10-13, each container assembly 100 is configured to hold at least one concentrate "C" therein, to be mixed with the diluent "D". Each container assembly 100 includes at least one container body 105, 110, 112, 114, 116, (FIGS. 10-11) for holding or storing the concentrate "C." Correspondingly, the number of end use products that can be dispensed through dispensing device 10 corresponds to the number of different container bodies 105, 110, 112, 114, 116, (FIGS. 10-11) and thus concentrates "C" that are incorporated into the particular container assembly 100.

Figure 12:
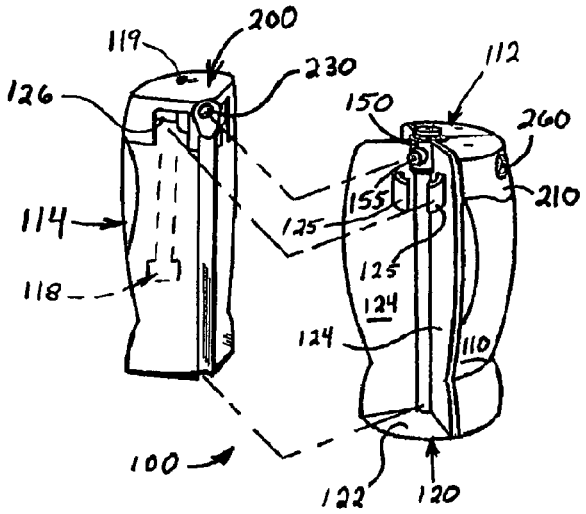
FIG. 12 is a perspective view of a container assembly of the present invention that incorporates multiple container bodies, with two container bodies removed.
Figure 13:
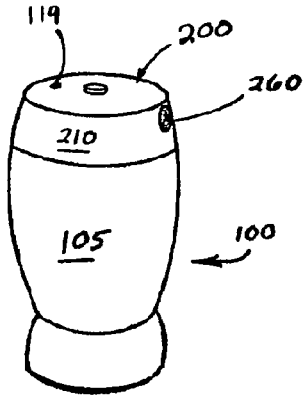
FIG. 13 is a perspective view of another container assembly of the present invention the incorporates a single container body.

The size and shape of the container body 105, 110, 112, 114, 116, may vary depending on the particular embodiment of the device 10. Several embodiments of the container body, as illustrated in FIGS. 11-13, include but are not limited to, a tubular, wedge, rectangular, or generally cylindrical shaped containers. In still another embodiment of the present invention, a single container body 105 is provided, similar to that illustrated in FIG. 13, only having multiple compartments, chambers, dividers, pockets, or any other means of separating a single void into multiple distinct liquid tight segments for housing individual concentrates "C".

Referring specifically to FIG. 12, container assemblies 100 have container bodies 105, 110, 112, 114, 116 that are not only liquid tight, but are also configured to vent their respective interior cavities to the ambient, reduce incidences of spilling when they are tipped or turned upside down, all while ensuring a quick response to trigger 30 actuation or other dispensing technique. Accordingly, a dip tube assembly 118, including a dip tube or other tubing-type segment and optionally a cooperating check valve, are housed in the container bodies 105, 110, 112, 114, 116. The dip tube assembly 118 is configured to convey the concentrate "C" out of the container bodies 105, 110, 112, 114, 116, explained in greater detail elsewhere herein, while ensuring that the dip tube remains full of concentrate "C" for quick concentrate "C" delivery without priming.

Referring now to FIGS. 12-13, container assemblies 100 preferably include vent mechanisms 119 that serve as both vents and checkvalves for the container bodies 105, 110, 112, 114, 116. Optionally separate and distinct vents are checkvalve are incorporated in lieu of an integral or unitary multifunctional vent mechanism 119. Vent mechanism 119 is configured to air to enter the interior portion of container bodies 105, 110, 112, 114, 116 while the concentrate "C" is being dispensed. This maintains the desired pressure within the container bodies 105, 110, 112, 114, 116 by replacing the volume that occupied by the dispensed concentrate "C," preventing undesired vacuum buildup within the container bodies 105, 110, 112, 114, 116. Preferably the vent mechanism 119 is made from a GORE-TEX® venting material, sintered-type or other suitable materials, optionally, vents, pinholes, and/or other mechanisms that permit air to enter but prevent concentrate "C" from escaping the container bodies 105, 110, 112, 114, 116.

Referring still to FIGS. 12-13, the container assemblies 100 can be generally modular enclosures which enable their removal, attachment, and interchangeability with the remainder of dispensing device 10. In such configuration, the various embodiments of container assemblies 100 are interchangeable with each other, whereby users can determine the number of end use products to be readily available by utilizing the dispensing device 10 at any given time. In other words, as desired, the user can implement (i) a container assembly 100 that houses multiple concentrates "C" in multiple container bodies 110, 112, 114, 116 (FIG. 12), or (ii) a container assembly 100 that houses a single concentrate "C" in a single container body 105 (FIG. 13), for either multiple or single end product capability, respectively.

Container assemblies 100 or portions thereof are preferably disposable use items. However, as desired, they can be adapted and configured for refillable use. Consequently, container assemblies 100 may have a cap or other removable or accessible structure allowing the container to be refilled.

3a. Multiple Container Bodies

Referring now to FIGS. 10-12, some container assemblies 100 have multiple container bodies 110, 112, 114, and 116. The multiple container bodies 110, 112, 114, 116 of container assembly 100 can be held in a rotating frame 120 that is a carousel-type mechanism configured to rotate about a vertical axis of rotation. Rotating frame 120 has a generally planar bottom wall 122 that has a generally circular perimeter shape. Multiple divider walls 124 extend upwardly from the bottom wall 122, intersecting each other and defining spaces therebetween. The spaces between adjacent divider walls 124 are configured to house, preferably removably house, the container bodies 110, 112, 114, 116 so that they, in combination, define the overall cylindrical configuration of container assembly 100.

The container bodies 110, 112, 114, 116 can be removably housed in the rotating frame 120 by way of, e.g., friction fit, snap-lock, and/or other mechanical temporary holding techniques and corresponding interfaces. As best seen in FIG. 12, one suitable way to configure a snap-lock arrangement is by providing one or more projection 125 can extend from one or more of the divider walls 124. One or more receptacles 126 can extend into, e.g., back, side, or other corresponding surfaces of the container bodies 110, 112, 114, 116 or components attached thereto.

In this configuration, the container body 110, 112, 114, 116 is installed by placing it into a space between adjacent divider walls 124, the projections 125 are aligned with the receptacles 126, and the container body 110, 112, 114, 116 is urged into place so that it nests snugly within such space. Urging the container body 110, 112, 114, 116 into place in this manner e.g., forces the projections 125 to resiliently flare outwardly as they slide through the receptacles 126 and over corresponding structure within the container body 110, 112, 114, 116. Once they clear or slide sufficiently far over such structure, the projections 125 bias back inwardly. This defines the snap-lock holding arrangement between the rotating frame 120 and the container body 110, 112, 114, 116. Other snap-lock and/or other temporary holding structures are contemplated and well within the scope of the invention, including but not limited to, e.g., various flex tabs and apertures, detents, external latches, and/or others as desired, which permit the removable attachment of the container body 110, 112, 114, 116 to the rotating frame 120.

Still referring to FIG. 12, a distribution collar 150 can be provided at the intersection of the divider walls 124, at the top end of rotating frame 120. Hollow projections 155 extend radially from the distribution collar 150, in the spaces between adjacent divider walls 124, and bores extend through the distribution collar 150 and each of the hollow projections 155, enabling fluid flow therethrough. Distribution collar 150 is configured to accept at least a portion of the downwardly extending elongate member 85 of pump outlet tubing 84 therein. Namely, the distribution collar 150 is sized and configured to cooperate with pump outlet tubing 84 so that the outlet bore 86 can be selectively aligned with one of the bores extending through the distribution collar 150 and respective one of the hollow projections 155.

Referring again to FIGS. 10-12, in such configurations, e.g., by way of rotating frame 120, the container assembly 100 in its entirety can be pivotally or rotatably connected by opposite ends thereof to the housing 20. The container assembly 100 preferably pivots or rotates while defining discrete positions throughout the range of rotation. The discrete positions can be defined by, for example, detents, or other mechanical structures that enable a user to index between such use positions for selecting the desired concentrate "C" and thus the desired end use product. Optionally, various printed or other indicia can be provided upon portions of the housing 20, e.g., upon the upper and/or lower retaining flanges 90, 92, to facilitate visual alignment of the desired or selected container body 110, 112, 114, 116.

Still referring to FIGS. 10-12, the rotating functionality of the container assembly 100 enables a user to singularly or selectably align any one of the container bodies 110, 112, 114, 116 with the reservoir 50. For example, the selected container body 110, 112, 114, 116 and its respective concentrate "C" is operably connected such that the diluent "D" of reservoir 50 mixes with the concentrate "C" during the momentary dispensing act, whereby the desired end use product is directed out of the dispensing device 10. Namely, the user rotates the container assembly 100 so that the desired container body 110, 112, 114, or 116 faces directly forward, aligning the desired container body with, e.g., the pump outlet tubing 84, explained in greater detail elsewhere herein.

Although the embodiment of container assembly 100 illustrated in, e.g., FIG. 11 can accommodate four separate container bodies 110, 112, 114, 116, the particular number of container bodies can be selected to correspond to the number of desired concentrates "C". In other words, container assemblies 100 that incorporate multiple container bodies can include, e.g., two, three, four, or more container bodies 110, 112, 114, and 116, as desired.

Furthermore, container assemblies 100 having multiple container bodies 110, 112, 114, and 116 do not have to rotate about a vertical axis such as those illustrated in FIGS. 3*a*, 3*b*, 4, 5, and 10-12, but can have other configurations depending on the intended end use design of dispensing device 10. Regardless of the particular configuration of dispensing device 10, the container assemblies 100 that utilize multiple container bodies 110, 112, 114, 116 are configured so that at any give time, a single container body 110, 112, 114, 116 is fluidly connected to, e.g., reservoir 50, allowing the diluent "D" and selected concentrate "C" to mix with each other during the dispensation act, exiting the dispensing device 10 as the intended end use product.

Figure 6:
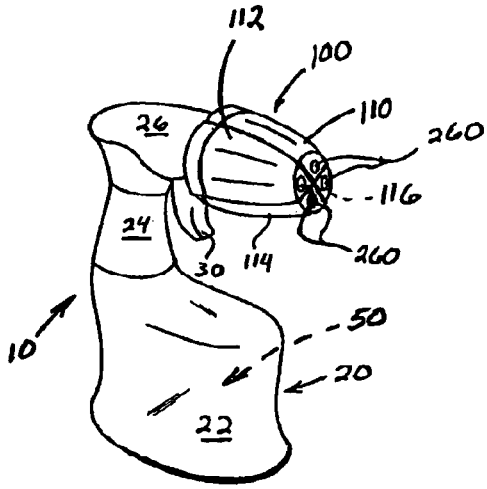
FIG. 6 is a perspective view of a fifth embodiment of a dispensing device of the present invention.

For example, FIG. 6 illustrates another embodiment of container assembly 100 that rotates for selecting the desired container bodies 110, 112, 114, 116, and corresponding concentrate "C" and end use product. However, the container assembly 100 seen in FIG. 6 rotates about a horizontal axis of rotation in lieu of a vertical axis of rotation such as those of FIGS. 3*a*, 3*b*, 4, 5, and 10-12.

Figure 7:
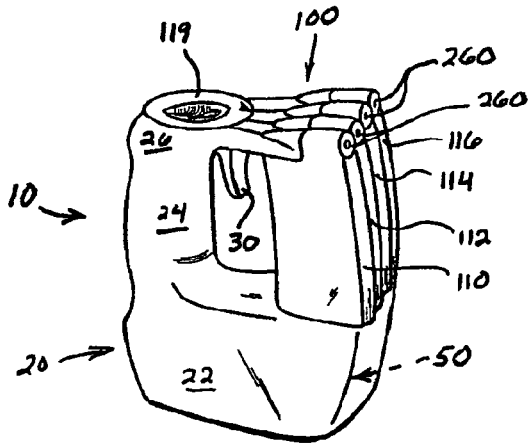
FIG. 7 is a perspective view of a sixth embodiment of a dispensing device of the present invention.

FIG. 7 depicts a further alternative embodiment of the container assembly 100 wherein the container bodies 110, 112, 114, 116 are still removably connected but remain stationary with respect to housing 20. In such embodiment, instead of aligning a movable container body 110, 112, 114, 116 with the pump outlet tubing 84, the pump outlet tubing is itself movable and can be selectively aligned with the desired (fixed or stationary) container body 110, 112, 114, 116, e.g., by way of a dial mechanism 119 or otherwise.

The alternative embodiments of FIGS. 8-9 show yet other suitable methods for aligning container bodies 110, 112, 114, 116 with the remainder of the dispensing device 10. In these embodiments, the head 60 and/or housing 20 is rotated to align corresponding conduits, passages, or other flow directing structures, permitting the diluent "D" and selected concentrate "C" to mix with each other during the dispensation act, exiting the dispensing device 10 as the intended end use product.

3b. Single Container Body

Figure 2:
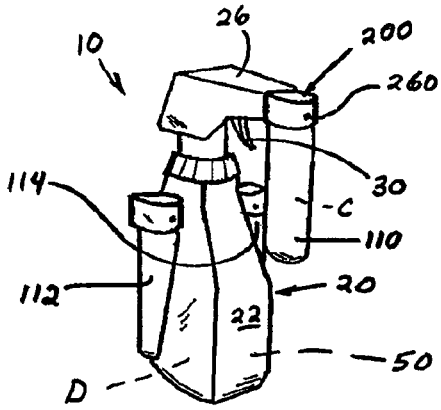
FIG. 2 is a perspective view of a second embodiment of a dispensing device of the present invention.
Figure 3A:
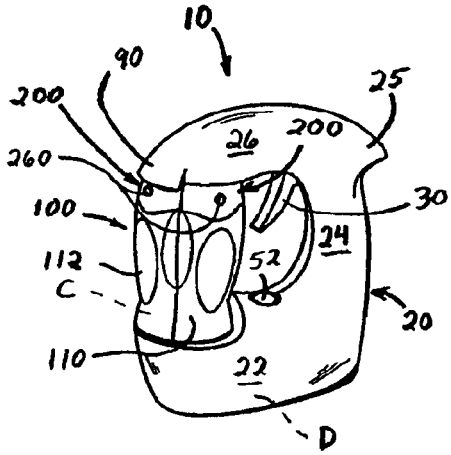
FIG. 3*a* is a perspective view of a variant of the dispensing device of FIG. 1.
Figure 3B:
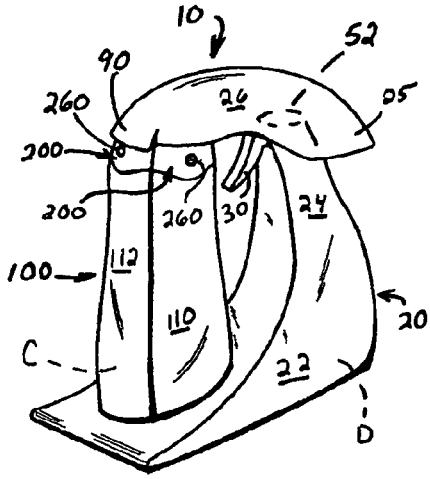
FIG. 3*b* is a perspective view of another variant of the dispensing device of FIG. 1.
Figure 4:
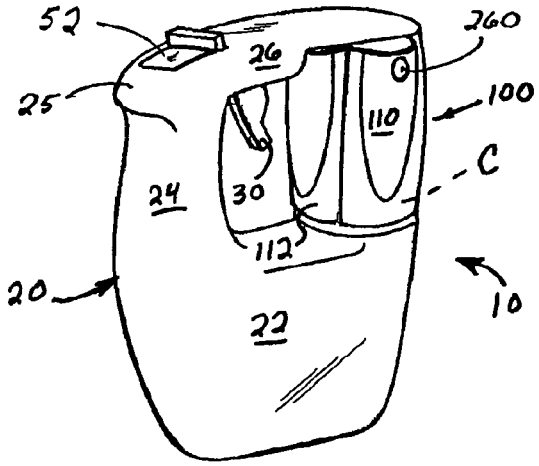
FIG. 4 is a perspective view of a third embodiment of a dispensing device of the present invention.
Figure 5:
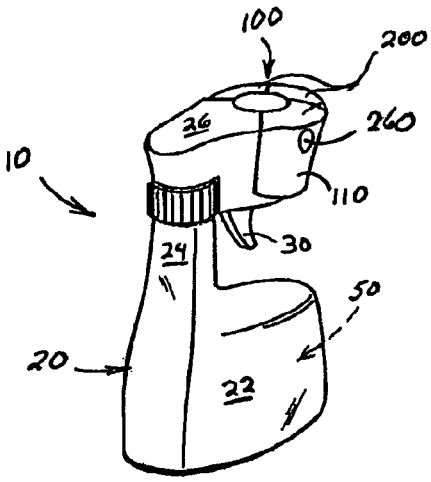
FIG. 5 is a perspective view of a fourth embodiment of a dispensing device of the present invention.

Referring now to FIGS. 1-2 and 13, some container assemblies 100 have a single container body 105. In such embodiments, the need for selective alignment of one of multiple container bodies is obviated so that any alignment facilitating structure(s) or indicia can be used to retain the single container body 105 in proper alignment with, e.g., the pump outlet tubing 84 until the user wishes to remove the container body 105 from the housing 20.

Referring now to FIGS. 1 and 13, as desired, the container assembly 100 having a single container body 105 can be interchangeable with those having multiple container bodies 110, 112, 114, 116 (seen in FIGS. 10-11). Accordingly, as desired, the container assembly 100 having a single container body 105 can have substantially the same shape, dimensions, and occupy the same space as the multiple container body versions. This permits the single container body 105 to hold relatively more concentrate "C" than any one of the multiple container bodies 110, 112, 114, or 116. Correspondingly, when the user anticipates using a relatively large volume of a single end use product, for example, when cleaning opposing surfaces of numerous windows, the user can implement a container assembly 100 with a single container body 105 which holds a concentrated glass cleaner as the concentrate "C".

Regardless of the particular implementation of container assembly 100, e.g., whether it includes a single container body 105 or multiple container bodies 110, 112, 114, and 116, each container body 105, 110, 112, 114, and 116 includes an outlet assembly 200 that is configured to permit the independently stored and maintained diluent "D" and concentrate "C" to mix with each other during the dispensation act or process, exiting the dispensing device 10 as the intended end use product.

4. Outlet Assembly

Referring now to FIGS. 11-17, the outlet assemblies 200 lie between and provide the interface between the reservoir 50 and the respective container bodies 105, 110, 112, 114, 116. Each outlet assembly 200 includes a cap 210 that houses a venturi assembly 220 and, optionally, a drip catch 300.

Figure 14:
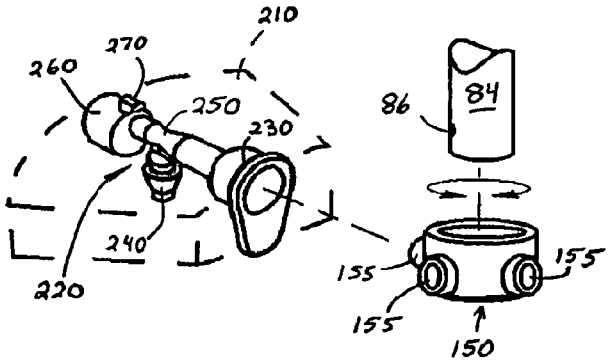
FIG. 14 is an exploded, perspective view of an outlet assembly and various cooperating components of the present invention.
Figure 15:
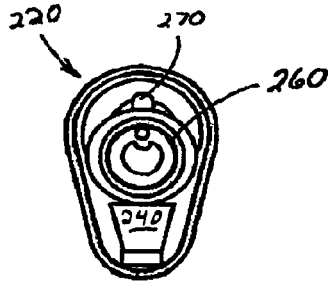
FIG. 15 is a front elevation view of the venturi assembly of FIG. 14.
Figure 16:
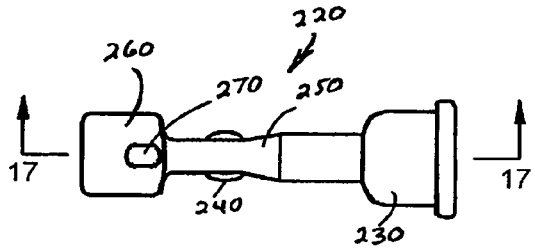
FIG. 16 is a top, plan view of the venturi assembly of FIG. 14.

Caps 210 sit atop the container bodies 105, 110, 112, 114, 116 and are generally hollow structures configured to fixedly, optionally removably house the venturi assembly 220 therein (FIGS. 11 and 14). The cap 210 is configured to cooperate and interface with other components of the dispensing device, e.g., pump outlet tubing 84, to ensure a sufficiently sealed connection therebetween and permit fluid flow from the reservoir 50 through the outlet assembly 200. As desired, various O-rings, seals, and/or other hardware can be provided within or adjacent the cap 210 to enhance the sealed interface or connection between the pump outlet tubing 84, namely, the outlet bore 86 thereof and the venturi assembly 220 (FIG. 14).

Referring now to FIGS. 14-17, each venturi assembly 220 includes a diluent inlet 230, a concentrate inlet 240, a venturi portion 250, a nozzle 260, and an alignment tab 270. Perhaps best seen in FIG. 17, the venturi assembly 220 can define a generally T-shaped configuration with the concentrate inlet 240 perpendicularly intersecting the venturi assembly 220 from below. To complete the T-shaped configuration of venturi assembly 220, the diluent inlet 230 and nozzle 260 extend generally axially away from opposing ends of the venturi portion 250.

Referring now to FIG. 14, diluent inlet 230 is selectively but operably sealed to the outlet bore 86 of pump outlet tubing 84. For example, the diluent inlet 230 can concentrically house the hollow projection 155 of extending from distribution collar 150. In such configuration, when the outlet bore 86 of pump outlet tubing 84 is aligned with a certain hollow projection 155, a liquid-tight fluid connection is established between the pump outlet tubing and the venturi assembly 220. This ensures that diluent "D" will flow through the outlet bore 86 of the pump outlet tubing 84, through the bore of the distribution collar and hollow projection 155, and through venturi assembly 220 during dispensing acts or procedures.

Referring again to FIGS. 14-17, concentrate inlet 240, extending downwardly from the remainder of venturi assembly 220, facilitates movement of the concentrate "C" from the container body 105, 110, 112, 114, 116 into the venturi assembly 220 where it mixes with diluent "D". In some embodiments, a hose, dip-tube, piece of tubing, or other conduit-type device extends from the concentrate inlet 240 into the container body 105, 110, 112, 114, 116 opening into the volume of concentrate "C". As desired, the concentrate inlet 240 can include a hose barb or shoulder to reduce the likelihood of non-desired removal of the hose, dip-tube, or piece of tubing therefrom. This can help ensure that, during use, the concentrate "C" will be able to be drawn upwardly through the concentrate inlet 240 into venturi portion 250.

Venturi portion 250 operates as a typical venturi device, according to known Bernoulli's principles, creating a pressure differential between the venturi portion 250 and the container body 105, 110, 112, 114, 116, whereby the concentrate "C" is pushed or drawn into the venturi portion 250. In other words, venturi portion 250 has first and second ends with relatively larger inner diameters that conically taper down to a reduced-diameter central segment 255.

Figure 17:
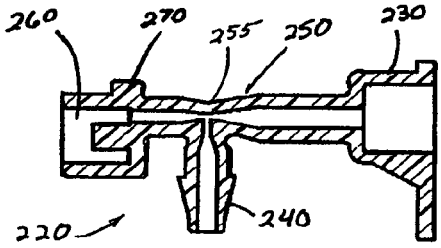
FIG. 17 is a cross-sectional view of the venturi assembly of FIG. 16 across line 17-17.

In this configuration, perhaps best appreciated from FIG. 17, while traversing the venturi portion 250 from the diluent inlet 230 toward the nozzle 260, the diluent "D" increases flow velocity but decreases pressure at the reduced-diameter central segment 255. This creates a low pressure zone at the reduced-diameter central segment 255, directly above the concentrate inlet 240, and a pressure differential between the reduced-diameter central segment 255 and the respective container body 105, 110, 112, 114, 116. The pressure differential causes a volume of concentrate "C" to flow upwardly through the concentrate inlet 240, radially into the reduced-diameter central segment 255 where it mixes with the diluent "D" flowing axially through reduced-diameter central segment 255. In this regard, the concentrate "C" and diluent "D" mix together while the two fluids are being expelled from the dispensing device 10. It is noted that while a venturi-type mixing procedure is described, it is clear that alternate embodiments may utilize any style of mixing, entraining, or otherwise combining ordinarily known to one skilled in the art to achieve the same result, wherein the concentrate "C" and diluent "D" are maintained as separated, distinct entities within the dispensing device 10.

Still referring to FIG. 17, intake side, e.g., the part of venturi portion 250 adjacent the diluent inlet 230 (the right side of venturi portion 250 as seen in FIG. 17), can be relatively larger than the output side, e.g., the part of venturi portion 250 adjacent the nozzle 260 (the left side of venturi portion 250 as seen in FIG. 17). For example, the intake side of venturi portion 250 can be at least about twice the length and at least about twice the diameter as the output side of venturi portion 250.

However, other relative dimensions of the various components of venturi assembly 220 are readily implemented as desired and well within the scope of the invention. The particular dimensions of the various components of venturi assembly 220 are based at least in part on, e.g., the desired spray pattern, the viscosity, density, and/or other characteristics that could influence flow of concentrate "C", the viscosity, density, and/or other characteristics that could influence flow of diluent "D," or other factors.

As the concentrate "C" and diluent "D" mix or combine together, they flow out of the venturi portion 250 into and through the nozzle 260 as a mixed end use product. Nozzle 260 determines the particular spray pattern and characteristics for the respective container body 105, 110, 112, 114, 116. Thus, the particular shape, dimensions, and/or other characteristics of nozzle 260 are selected based on the desired end use spray characteristics for the particular dispensed end use product.

Drip catch 300, best seen in FIGS. 10-11, can include, e.g., an aperture extending through a front wall of cap 210. Drip catch 300 is adapted and configured to collect or convey residual drips from nozzle 260. Preferably an absorbent material is housed within the cap 210 behind the drip catch 300, whereby residual drips are wicked into the drip catch 300 and removed from the front surface of cap 210 without requiring user manipulation. The residual drips can be stored in the absorbent material or drain back into the respective container body 105, 110, 112, 114, 116, depending on the particular configuration of the drip catch 300.

III. System Use

In view of the above, to use the dispensing device 10, a user determines the desired end use product and then selects a corresponding container body 105, 110, 112, 114, 116 that has a concentrate "C" of such end use product. For example, the user can install a single container body 105 into the dispensing device 10 or rotate a container assembly 100 so that the desired container body 110, 112, 114, 116 faces forward, aligning the respective outlet assembly 200 with the pump outlet tubing 84.

The user actuates trigger 30 which draws diluent "D" from reservoir 50 into and through the manual pump assembly 35. The diluent "D" is forced out of the manual pump assembly 35 and directed to the outlet assembly 200 by way of the pump outlet tubing 84. The diluent then flows through the outlet assembly 200, gaining velocity and dropping pressure as it passes through the venturi portion 250. In response to the dropping pressure of diluent "D" within venturi portion 250, concentrate "C" is drawn from the container body 110, 112, 114, 116, through the dip tube assembly 118 and its respective checkvalve, and into the venturi portion 250. In the venturi portion 250, the diluent "D" and concentrate "C" mix with each other, creating the end use product. The end use product exits the dispensing device 10 through nozzle 260.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements. Expedient embodiments of the present invention are differentiated by the appended claims.

What is claimed is:

1. A handheld device for dispensing multiple end use products, comprising:

a main body segment;

a handle extending upwardly from the main body segment;

a head extending from the handle and that is spaced from the main body segment;

a reservoir defined within the body and holding a volume of diluent therein;

a container assembly arranged for support between the main body segment and the head so that the main body segment extends below the container assembly and the head extends above the container assembly, the container assembly having multiple container bodies holding concentrates and removably housed therein;

an outlet assembly having a venturi portion operably coupled to each of the multiple container bodies for respectively directing the concentrates out of the container bodies to be mixed with the diluent;

a distribution collar coupled to a diluent inlet of the venturi portion and comprising a plurality of projections having bores that extend longitudinally with respect to the projections and extend radially with respect to the distribution collar, wherein the plurality of projections is configured to correspond to the number of container bodies, and wherein the distribution collar is rotatable about a rotational axis to selectively align one of the bores of the plurality of projections with the diluent inlet; and a pump and a pump outlet tube connecting the pump to the distribution collar such that the distribution collar directs diluent from the pump outlet tube through the venturi portion;

wherein multiple end use products can be dispensed from the device, the number of possible end user products corresponding to the number of container bodies in the container assembly.

2. The device of claim 1, wherein the container assembly is rotatable about a generally vertical axis of rotation for selecting a desired end use product for dispensation.

3. The device of claim 1, wherein the container assembly is rotatable about a generally horizontal axis of rotation for selecting a desired end use product for dispensation.

4. The device of claim 1, wherein the container assembly has multiple nozzles for outputting end use product, the number of nozzles corresponding to the number container bodies in the container assembly.

5. The device of claim 1, wherein the container bodies are removably mounted to a rotatable frame.

6. The device of claim 1, wherein each of the container bodies of the container assembly includes a dip tube arranged within the respective container body and having a lower end positioned toward a lower end of the container body and an upper end positioned toward an upper end of the container body, the upper end of the dip tube connected to a concentrate inlet of the respective venturi portion for directing a concentrate held in the container body to the venturi portion for delivery out of the device.

7. A handheld device for dispensing multiple end use products, comprising:

a main body segment;

a handle extending upwardly from the main body segment;

a head extending from the handle and that is spaced from the main body segment;

a reservoir defined within the body and holding a volume of diluent therein;

a container assembly arranged for support between the main body segment and the head so that the main body segment extends below the container assembly and the head extends above the container assembly, the container assembly having multiple container bodies holding concentrates and removably housed therein;

an outlet assembly having a venturi portion operably coupled to each of the multiple container bodies for respectively directing the concentrates out of the container bodies to be mixed with the diluent;

a distribution collar coupled to a diluent inlet of the venturi portion and comprising a plurality of projections having bores that extend longitudinally with respect to the projections and extend radially with respect to the distribution collar, wherein the plurality of projections is configured to correspond to the number of container bodies, and wherein the distribution collar is rotatable about a rotational axis to selectively align one of the bores of the plurality of projections with the diluent inlet; and a pump and a pump outlet tube connecting the pump to the distribution collar such that the distribution collar directs diluent from the pump outlet tube through the venturi portion;

wherein multiple end use products can be dispensed from the device, the number of possible end user products corresponding to the number of container bodies in the container assembly;

wherein each of the container bodies of the container assembly includes a dip tube arranged within the respective container body and having a lower end positioned toward a lower end of the container body and an upper end positioned toward an upper end of the container body, the upper end of the dip tube connected to a concentrate inlet of the respective venturi portion for directing a concentrate held in the container body to the venturi portion for delivery out of the device; and wherein the venturi portions of the outlet assembly longitudinally align with respective ones of the plurality of hollow projections of the distribution collar such that the venturi portions extend radially from the distribution collar and face different directions with respect to each other.

8. A handheld device for dispensing fluids, comprising:

a housing having a handle;

a reservoir arranged within the housing and holding a diluent;

a pump arranged within the housing and having a tube extending with respect to the reservoir and the pump for conveying the diluent out of the reservoir during actuation of the pump;

a distribution collar connected to an outlet of the tube to receive the diluent in an axial direction relative to the distribution collar during actuation of the pump, the distribution collar defining multiple bores extending radially through the distribution collar for delivering the diluent out of the distribution collar in a radial direction relative to the distribution collar, wherein the distribution collar is rotatable about an axis for selectively fluidly connecting one of the multiple bores to the outlet of the tube;

a container assembly supported by the housing and having multiple container bodies removably housed therein, wherein each container body holds a concentrate and includes a dip tube configured for directing the concentrate out of the container body;

an outlet assembly including multiple venturies with each venturi having a concentrate inlet, a diluent inlet, and a nozzle, wherein each venturi is arranged with respect to one of the container bodies and one of the bores of the distribution collar with the concentrate inlet of the venturi connected to the dip tube of the respective container body and the diluent inlet is connected to the respective bore of the distribution collar to selectively fluidly couple concentrate from the selected container body with the diluent to mix during actuation of the pump for dispensing a mixed product through the nozzle of the venturi corresponding to the selected container body; and wherein multiple end use products can be dispensed from the device, the number of possible end use products corresponding to the number of concentrates in the container bodies in the container assembly.

9. The device of claim 8, wherein the venturies of the outlet assembly align with respective ones of the bores of the distribution collar such that the venturies extend radially from the distribution collar and face different directions with respect to each other.

10. A handheld device for dispensing fluids, comprising:

a housing having a handle;

a reservoir arranged within the housing and holding a diluent;

a pump arranged within the housing and having a tube extending with respect to the reservoir and the pump for conveying the diluent out of the reservoir during actuation of the pump;

a distribution collar connected to an outlet of the tube to receive the diluent during actuation of the pump, the distribution collar defining multiple bores extending radially through the distribution collar and wherein the distribution collar is rotatable about an axis for selectively fluidly connecting one of the multiple bores to the outlet of the tube;

a container assembly supported by the housing and having multiple container bodies removably housed therein, wherein each container body holds a concentrate and includes a dip tube configured for directing the concentrate out of the container body; and an outlet assembly including multiple venturies with each venturi having a concentrate inlet, a diluent inlet, and a nozzle, wherein each venturi is arranged with respect to one of the container bodies and one of the bores of the distribution collar with the concentrate inlet of the venturi connected to the dip tube of the respective container body and the diluent inlet is connected to the respective bore of the distribution collar to selectively fluidly couple concentrate from the selected container body with the diluent to mix during actuation of the pump for dispensing a mixed product through the nozzle of the venturi corresponding to the selected container body;

wherein the venturies of the outlet assembly align with respective ones of the bores of the distribution collar such that the venturies extend radially from the distribution collar and face different directions with respect to each other;

wherein the venturies are fixed with respect to the bores of the distribution collar so that the venturies and bores remain in alignment while the distribution collar and venturies rotate in unison with respect to each other; and wherein multiple end use products can be dispensed from the device, the number of possible end use products corresponding to the number of concentrates in the container bodies in the container assembly.

* * * * *